United States Patent [19]

Singh

[11] Patent Number: 5,016,789

[45] Date of Patent: May 21, 1991

[54] DISPENSER FOR GRANULAR MATERIALS

[76] Inventor: Ramnaraine Singh, 130 Ashton Crescent, Brampton, Ontario, Canada, L6S 3J9

[21] Appl. No.: 374,767

[22] Filed: Jul. 3, 1989

[30] Foreign Application Priority Data

Jul. 15, 1988 [CA] Canada ..... 572224

[51] Int. Cl.[5] ..... B67D 5/06; G01F 11/28

[52] U.S. Cl. ..... 222/608; 222/185; 222/457

[58] Field of Search ..... 222/181, 185, 357, 457, 222/564, 608, 459; 119/52.1, 52.4, 54, 55

[56] References Cited

U.S. PATENT DOCUMENTS

| | | | |
|---|---|---|---|
| 250,159 | 11/1881 | Mills | 222/457 X |
| 352,195 | 1/1886 | Krag | 222/457 |
| 528,355 | 1/1894 | Bain | 222/457 |
| 1,220,422 | 1/1917 | Hewitt | 222/185 X |
| 1,660,284 | 1/1928 | Waters | 222/457 X |
| 1,762,530 | 6/1930 | Sandell | 222/457 |
| 1,845,847 | 2/1932 | Reuther | 222/459 |
| 2,065,860 | 12/1936 | Le Page | 222/457 |
| 2,582,207 | 1/1952 | Shaw | 222/457 |
| 2,762,529 | 9/1956 | Johnson | 222/457 X |
| 2,922,552 | 1/1960 | Berger et al. | 222/457 X |
| 4,180,014 | 12/1979 | Mathews | 222/457 X |

FOREIGN PATENT DOCUMENTS

| | | | |
|---|---|---|---|
| 648274 | 7/1937 | Fed. Rep. of Germany | 222/459 |

*Primary Examiner*—Michael S. Huppert
*Assistant Examiner*—Kenneth R. DeRosa

[57] ABSTRACT

A mobile dispenser for granular safety material and having a container with an upper end and a lower end, a floor at the lower end, wheels on the floor, a dispensing opening at the front of the container with a dispensing tray extending forwardly from the opening, front and rear baffle plates fixedly secured in the container, and angled towards each other and creating a flow restricting gap at their free edges which gap opens towards the rear of the container so as to direct flow of granular material away from the opening.

8 Claims, 3 Drawing Sheets

DISPENSER FOR GRANULAR MATERIALS

The invention relates to a dispenser for granular safety materials such as, for example, salt, or other sidewalk chemicals, and to floor safety material for floor materials such as sand, saw dust and dry absorbent materials such as those used in machine shops.

In many workplaces such as machine shops, slaughter houses, and the like, the floor in the work space becomes soiled with waste products such as cutting fluid from metal working machines, fat and body fluids in the slaughter houses and the like. In this condition the floor is extremely hazardous and is a common cause of accident. In order to overcome the problem, it is customary to spread some kind of granular material on the floor from time to time. Typical products in use are sand, saw dust, and the like. In some cases, specially manufactured dry absorbent granular materials are used, which are sold under various proprietary brand names. For the purposes of this explanation all of such materials are referred to as "granular safety materials", or simply, "granular material".

In the past, such granular safety materials have usually been supplied in either a sack or in a drum. The normal practice is to simply leave the open sack or drum in a convenient place, and to spread the granular material from time to time with a scoop or shovel.

One of the problems with this is that a drum or sack of granular material is relatively difficult to move. Consequently work sites at a distance from the drum or sack may be serviced less frequently than is desirable. In addition, it means that a machinist must take time off his machine to walk perhaps a considerable distance carrying a shovel of material.

Removing material from a partly empty sack or drum is tiresome and often wasteful.

Salt is another granular safety material which is commonly distributed on the sidewalk or steps to melt ice. Similar problems to those described above arise in connection with the handling of bags of salt.

Clearly a more efficient distribution system for such granular materials would improve the safety of the work space or home and would also improve the efficiency of the workmen at the machines.

Accordingly, with a view to overcoming the various disadvantages noted above, the invention provides a mobile dispenser for granular safety materials and comprising a container portion having walls defining an upper end and a lower end, a floor panel at the lower end of said container, wheel means on said floor panel, whereby the same may be wheeled about, opening means in a lower portion of said container, a dispensing tray portion extending from said floor panel, adjacent to said opening means, a front baffle plate located within said container above said opening means, and angled downwardly away from said opening means, a rear baffle plate located within said container, and angled downwardly toward said opening means, and a flow restricting gap defined by the two lower free edges of said front and rear plates, the free edge of said front plate being lower than the free edge of the said rear plate, and handle means for controlling said container.

More particularly, it is an objective of the invention to provide a mobile dispenser having the foregoing advantages wherein said gap defined by said front and rear plates is located at a point offset from the central axis of said container, rearwardly from said opening means.

More particularly, it is an objective of the invention to provide a mobile dispenser having the foregoing advantages wherein said front plate is located at a first angle, and wherein said rear plate is located at a second angle, and wherein said flow restricting gap has a maximum width dimension of between about 0.75 and 1.25 of an inch, and lies in a generally vertical plane.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
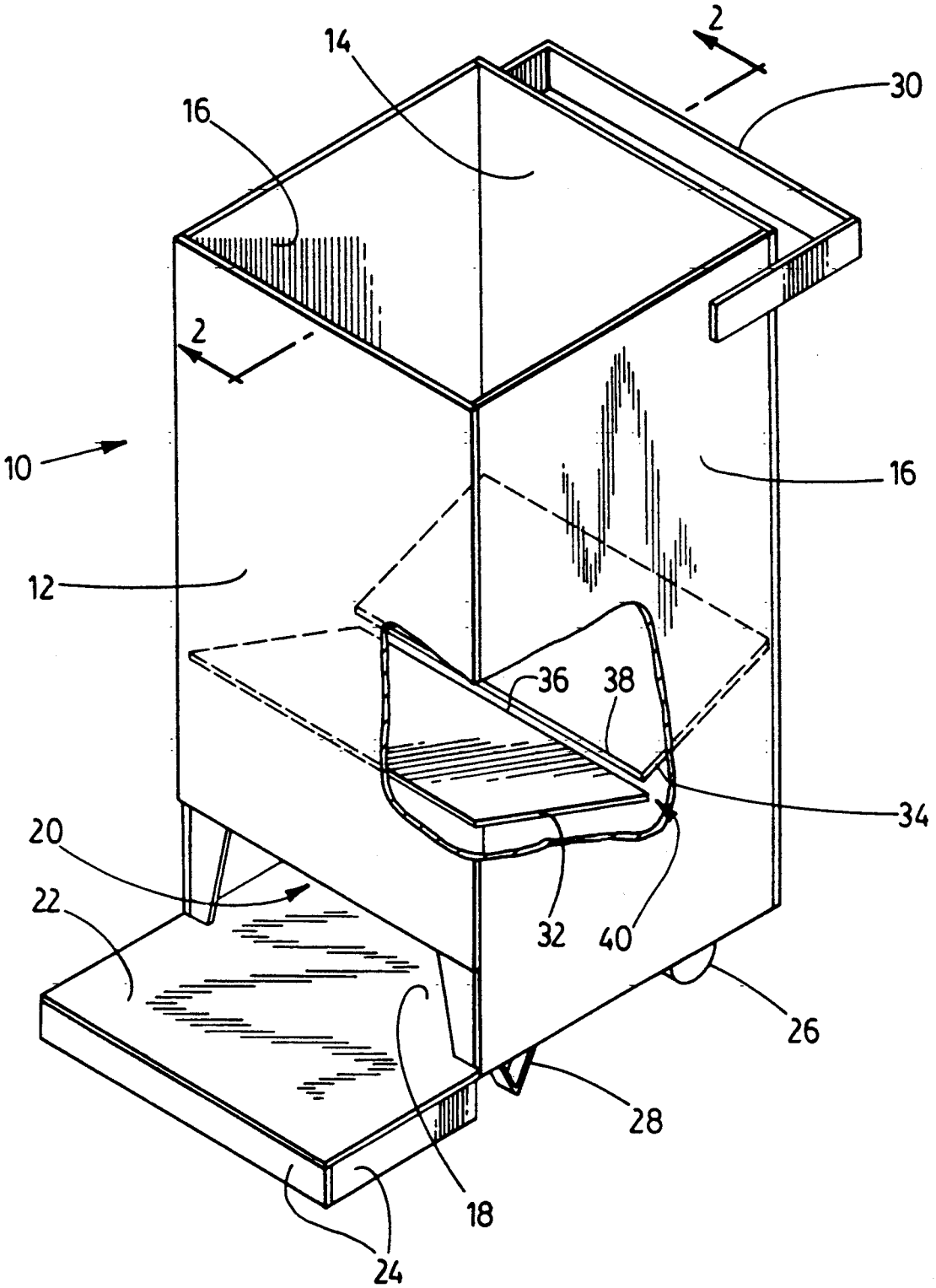
FIG. 1 is a perspective illustration of a mobile dispenser for granular safety material, partially cut away to reveal its construction.

Referring now to FIG. 1, the dispenser is there shown in the form of a generally rectangular shape.

It will however be appreciated that the invention is not limited solely to such a shape but comprehends containers of other shape.

As shown in FIG. 1, container 10 is of rectangular shape in plan, having front and back walls 12 and 14 and side walls 16.

The lower end of the container 10 is closed off by a floor 18.

Front wall 12 is cut away so as to define a rectangular dispensing opening 20. A dispensing tray 22 extends forwardly from the opening 20, being in fact provided by a forward extension of the floor 18. Downwardly dependent skirt walls 24 are formed on tray 22 for safety reasons.

Wheels 26 are provided towards the rear of container 10, and legs 28 are provided towards the front. A handle 30 attached to rear wall 14 enables the dispenser to be tipped rearwardly and wheeled about the work space.

While the handle is merely shown as a C-shaped structure attached to the rear wall, it can, of course, be shaped so as to extend upwardly to a greater height if desired.

Within the container 10, there are located a front baffle plate 32 and a rear baffle plate 34. The two baffle plates are fastened within the walls of the container. Front baffle plate 32 is secured to front wall 12, and side walls 16, and extends rearwardly at a downward angle. Rear baffle plate 34 is secured to rear wall 14 and side walls 16, and extends forwardly at a downward angle.

The two baffle plates defined free edges 36 and 38 which are located spaced apart in a predetermined relation, and define a flow restricting gap 40 therebetween.

Figure 2:
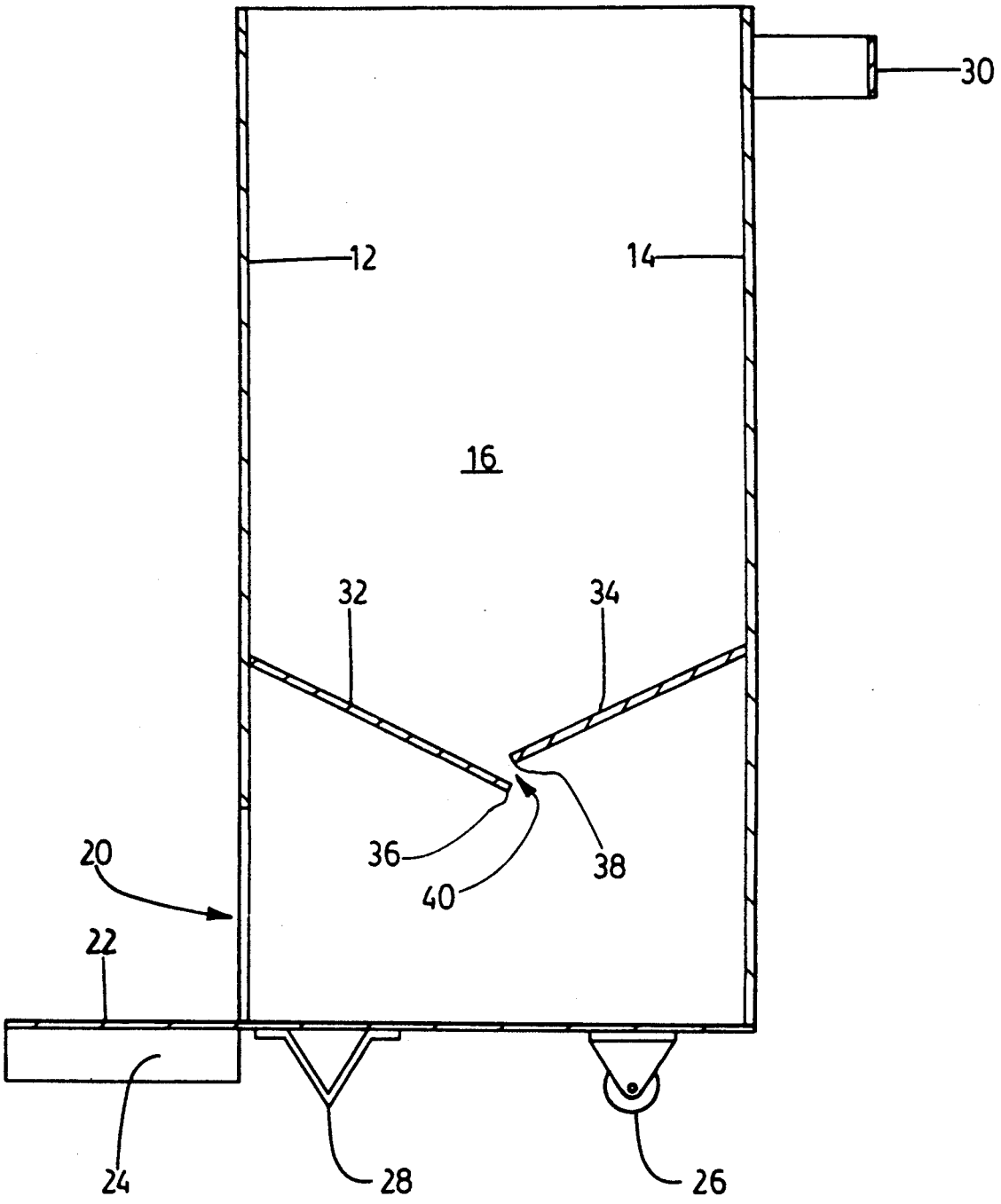
FIG. 2 is a section along the line 2—2 of FIG. 1.

As best shown in FIG. 2, the front plate lies at an angle of approximately 18 degrees below the horizontal. The rear plate lies at an angle of about 12 degrees.

The front plate is somewhat longer than the rear plate, and thus the free edge 36 of the front plate 32 lies more or less below the free edge 38 of the rear plate 34.

Thus the gap 40 lies in a plane at or near to the vertical, and is located offset from the central axis of the container, rearwardly from the opening 20.

The gap 40 will have a width dimension of between 0.75 and 1.25 of an inch, and in this case is 1 inch. The width of the gap may be varied depending upon the type of granular material for which the dispenser is designed. Thus, for example, dry absorbent materials are usually somewhat coarse grain size. Other granular materials such as some forms of salt or chemical compounds that are used for ice melting are somewhat finer.

When granular safety materials are placed in the upper end of the container 10, they will rest on the two plates 32 and 34. Some of the granular material will flow through the gap 40, and accumulate on the floor 18. Due to the more or less vertical orientation of the gap, and the fact that the front plate is lower than the rear plate, the flow will occur towards the rear of the floor 18 and will build up there, and will flow forwardly towards the opening only when a substantial quantity of material has already built up, and some may then flow outwardly onto the tray 22.

It will be noted that the lower edge 34 of the front plate 32, on the underside of the gap 40, is located at a distance above the floor 18, the distance being slightly less than the length of the shorter of the two plates, namely rear plate 34.

Once the pile of granular material on the floor accumulates to a sufficient height, it will reach the gap 40, and this will thus hinder or restrict any further substantial flow, making the dispenser essentially self-regulating in operation.

Persons may then simply shovel or scoop the material from the tray 22 and spread it about where it is required. When the dispenser is required elsewhere, it can simply be tipped rearwardly by means of the handle 30 and wheeled about.

Figure 3:
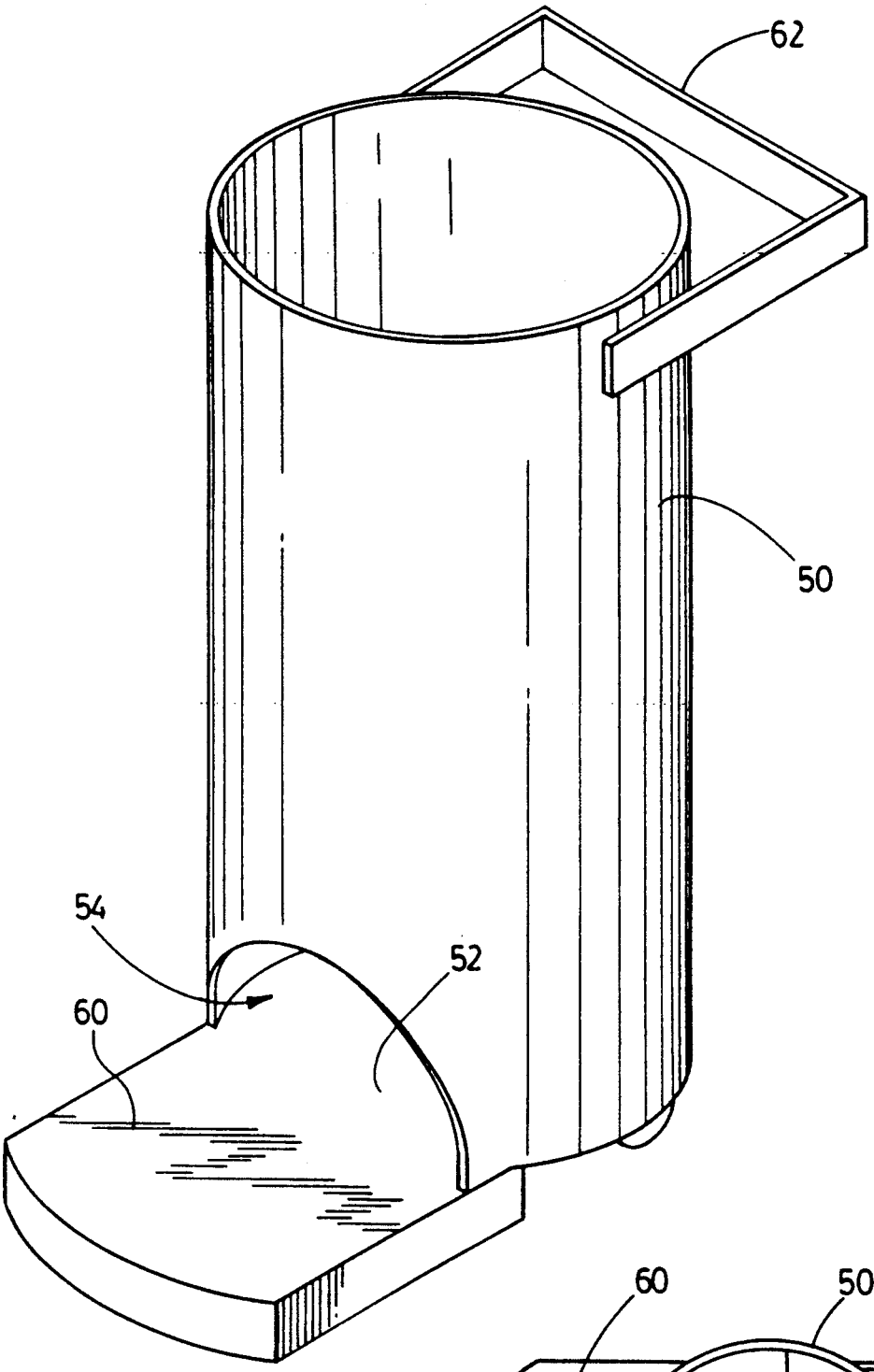
FIG. 3 is a perspective illustration of an alternate embodiment.
Figure 4:
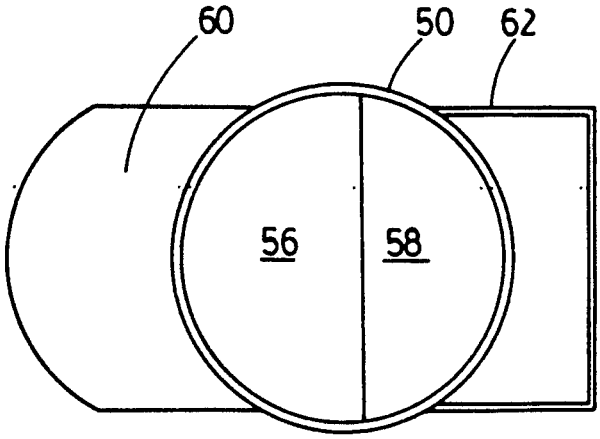
FIG. 4 is a top plan view of the embodiment of FIG. 3.

An alternate embodiment of the invention is shown in FIGS. 3 and 4. In this case a container 50 is provided of cylindrical shape, having a floor 52 and an arcuate dispensing opening 54.

In this case the angles are somewhat greater. The front plate 56 is at about 22 degrees and the rear plate 58 is about 17 degrees.

Front baffle plate 56 and rear baffle plate 58 are provided, having a relationship similar to that of the plates 32 and 34 of the embodiment in FIG. 1.

A dispensing tray 60 extends forwardly from the opening 52, and a handle 62 is provided rearwardly of opening 54.

Legs and wheels (not shown) are provided as in the FIG. 1 embodiment.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A mobile dispenser for granular safety material and comprising:

a container portion having walls defining an upper end and a lower end and front and back and side wall portions;

a floor panel at the lower end of said container;

wheel means on said floor panel, whereby the same may be wheeled about;

opening means in a lower portion of said front portion of said walls of said container portion;

a dispensing tray portion extending forwardly from and substantially level with said floor panel, adjacent to said opening means;

a front baffle plate fixedly located within said container portion above said opening means, and joined to said front portion and said side portions of said walls and extending rearwardly towards said back portion thereof, and angled downwardly away from said opening means, said front baffle plate defining a front free edge extending between said side wall portions intermediate said front and back wall portions;

a rear baffle plate fixedly located within said container portion, and joined to said back portion and said side portions of said walls and extending forwardly towards said front portion thereof, and angled downwardly toward said opening means, said rear baffle plate defining a rear free edge extending between said side wall portions intermediate said front and back wall portions;

a flow restricting gap defined by said free edges of said front and rear baffle plates, said front free edge of said front plate being located lower than said rear free edge of said rear plate, wherein said gap opens rear-wardly with respect to said front wall portion, and, handle means for controlling said dispenser.

2. A mobile dispenser as claimed in claim 1 wherein said gap defined by said front and rear plates is located at a point offset within said container, rearwardly from said opening means.

3. A mobile dispenser as claimed in claim 1 wherein said container portion is rectangular in section and wherein said front baffle plate is located at an angle in the region of 18 degrees, and wherein said rear baffle plate is located at an angle in the region of 12 degrees, and wherein said flow restricting gap has a maximum width dimension of between about 0.75 and 1.25 of an inch.

4. A mobile dispenser as claimed in claim 1 wherein said flow restricting gap is located offset towards said back portion of said walls of said container.

5. A mobile dispenser as claimed in claim 1 including a downwardly dependent skirt portion formed around said dispensing tray portion.

6. A mobile dispenser as claimed in claim 1 wherein said container portion is of generally cylindrical shape, and wherein said front baffle plate is located at an angle in the region of 22 degrees, and wherein said rear baffle plate is located at an angle in the region of 17 degrees.

7. A mobile dispenser for granular safety material and comprising:

a container portion of rectangular cross section having front and back walls and side walls and together defining an upper end and a lower end;

a floor panel at the lower end of said container;

wheel means on said floor panel, whereby the same may be wheeled about;

opening means in a lower portion of said front wall of said container portion;

a dispensing tray portion extending from said floor panel, adjacent to said opening means;

a front baffle plate fixedly located within said container portion above said opening means, and joined to said front portion and said side portions of said walls and extending rearwardly towards said back portion thereof, and angled downwardly away from said opening means at an angle in the region of 18 degrees, said front baffle plate defining a front free edge extending between said side wall portions intermediate said front and back wall portions;

a rear baffle plate fixedly located within said container portion, and joined to said back portion and said side portions of said walls and extending forwardly towards said front portion thereof, and angled downwardly toward said opening means at an angle in the region of 12 degrees, said rear baffle plate defining a rear free edge extending between said side wall portions intermediate said front and back wall portions;

a flow restricting gap defined by said free edges of said front and rear baffle plates, said front free edge of said front plate being located lower than said rear free edge of said rear plate, said flow restricting gap having a maximum width dimension of between about 0.75 and 0.125 of an inch, and said gap lying in a plane approximately vertical; said gap being directed rearwardly, with respect to said front wall portions, and wherein said front baffle plate has a predetermined first length, and said rear baffle plate has a predetermined second length, and wherein said second length is less than said first length, and wherein said free edge of said front baffle plate is located at a height above said floor panel which is less than said predetermined second length, said gap extending from side to side of said container, and being offset rearwardly from the center of said container.

8. A mobile dispenser for granular safety material and comprising:

a container portion of generally cylindrical cross-section having walls defining an upper end and a lower end and front and back, and side wall portions;

a floor panel at the lower end of said container;

wheel means on said floor panel, whereby the same may be wheeled about;

opening means in a lower portion of said front portion of said walls of said container portion;

a dispensing tray portion extending forwardly from and substantially level with said floor panel, adjacent to said opening means;

a front baffle plate fixedly located within said container portion above said opening means, and joined to said front portion and said side portions of said walls and extending rearwardly towards said back portion thereof, and angled downwardly away from said opening means at an angle in the region of 22 degrees, said front baffle plate defining a front free edge extending between said side wall portions intermediate said front and back wall portions;

a rear baffle plate fixedly located within said container portion, and joined to said back portion and said side portions of said walls and extending forwardly towards said front portion thereof, and angled toward said opening means at an angle in the region of 17 degrees, said rear baffle plate defining a rear free edge extending between said side wall portions intermediate said front and back wall portions;

a flow restricting gap defined by said free edges of said front and rear baffle plates, said front free edge of said front plate being located lower than said rear free edge of said rear plate, said flow restricting gap having a maximum width dimension of between about 0.75 and 0.125 of an inch, and said gap lying in a plane approximately vertical; being directed rearwardly away from said opening means, and wherein said front baffle plate has a predetermined first length, and said rear baffle plate has a predetermined second length, and wherein said second length is less than said first length, and wherein said free edge of said front baffle plate is located at a height above said floor panel which is less than said predetermined second length, said gap extending from side to side of said container, and being offset rearwardly from the center of said container.

* * * * *